United States Patent [19]

Albanese

[11] 4,213,767

[45] Jul. 22, 1980

[54] ELECTROSTATIC PRECIPITATION

[75] Inventor: Vincent M. Albanese, Lockport, Ill.

[73] Assignee: Nalco Chemical Company, Oak Brook, Ill.

[21] Appl. No.: 38,597

[22] Filed: May 14, 1979

[51] Int. Cl.[2] ..... B03C 1/00

[52] U.S. Cl. ..... 55/5

[58] Field of Search ..... 55/5

[56] References Cited

U.S. PATENT DOCUMENTS 2,381,879 8/1945 Chittum ..... 55/5

*Primary Examiner*—Bernard Nozick

*Attorney, Agent, or Firm*—John G. Premo; Robert A. Miller

[57] ABSTRACT

A method for the electrostatic precipitation of dust particles entrained in a gas stream which comprises adding predetermined amounts of hexamethylene tetramine or its water-soluble salts into the particle-laden gas stream in a location preceding the precipitation apparatus where the gas is at a temperature not greater than 800° F.

2 Claims, No Drawings

ELECTROSTATIC PRECIPITATION

DESCRIPTION OF THE PRIOR ART

A conventional way of separating dust particles from a gas stream in which the particles are entrained is by the use of an electrostatic precipitator. This apparatus utilizes the corona discharge effect, i.e., the ionization of the particles by passing them through an ionization field established by a plurality of discharge electrode wires suspended in a parallel plane with a grounded collecting electrode plate. The ionized particles are attracted to the collector plate from which they may be removed by vibrating or rapping the plate. Examples of this type precipitator are found in Cummings' U.S. Pat. No. 3,109,720 and Pennington U.S. Pat. No. 3,030,753.

Dust particles have different characteristics depending upon their source. One characteristic is resistivity which is measured in ohm-centimeters. For example, where the source of particles is a coal-fired boiler, there is usually a predictable relationship between the type of coal burned and the resistivity of the particles. Typically, low sulphur coal, i.e., less than 1% sulphur, produces particles having high resistivity, i.e. $10^{+13}$ ohm-centimeters resistance; coal with 3-4% sulphur procudes particles having $10^{+8}$–$10^{+10}$ ohm-cm. resistance; and, poorly combustible coal produces particles having $10^{+4}$–$10^{+5}$ ohm-cm. resistance.

It has been found that most efficient separation or precipitation of the particles occurs when their resistivity is about $10^{+8}$–$10^{+10}$ ohm-centimeters. When the resistivity is higher than this, the precipitation process is encumbered because the particles tend to hold their charge; particles collected on the plate in a layer tend to remain negatively charged and particles subsequently charged in the gas stream are not attracted to the plate with a resultant loss of efficiency. Conversely, when the resistivity is lower than this, the low resistivity particles lose their charge rapidly upon contact with the collector plate, thereby being difficult to retain thereon; reentrainment then occurs with a resultant loss of efficiency. However, when the particles are of the preferred resistivity, a balance is achieved between the tendency to have either overcharged or undercharged particles with a resultant increase in precipitation efficiency. Thus, the problem which existed until now was to provide a means for reducing the resistivity of high-resistivity particles and increasing the resistivity of low-resistivity particles.

THE INVENTION

The electrostatic removal of high-resistivity particles entrained in a gas stream can be improved by the addition to such gas stream of pre-selected amounts of hexamethylene tetramine and its salts.

Dosage

The amount of hexamethylene tetramine that is effective in decreasing the resistivity of the dust particles may vary. Generally it is used in an amount ranging from 0.1 up to about 6 weight percent based on the weight of the particles present in the gas stream. In a preferred embodiment, the dosage ranges between0-.5-3% by weight.

A convenient method of dosing the hexamethylene tetramine is to add 45–1250 grams per metric ton of coal burned to form the gas.

Application Temperature

Most large coal-fired boilers are composed of a number of regions. These regions, starting with the combustion flame and ending with the electrostatic precipitator which, in most instances, is located prior to the exhaust gas stack, form a series of progressively cooler gas temperature zones. For purpose of simplification, these zones and their respective temperatures are set forth below in a simplified manner:

| Location | Temperature |
|---|---|
| In the flame | 2500°–3500° F. |
| In the furnace-radiant section | 2000°–2500° F. |
| After super heater | 1000°–1600° F. |
| After economizer | 500°–750° F. |
| After air heater | 250°–350° F. |
| Up the stack | 250°–350° F. |

The hexamethylene tetramine is added to the gas stream at a temperature in excess of about 250° F., but, preferably, at a temperature not greater than 800° F. and, most preferably, not greater than 500° F.

Hexamethylene tetramine may be employed as such but, preferably, it is in the form of a dilute solution. In addition to using hexamethylene tetramine per se or its solutions, the invention contemplates using the water-soluble salts of hexamethylene tetramine such as, but not limited to, the mineral acid salds thereof, e.g., chlorides, sulfates, nitrates and phosphates. Other water-soluble salts include carboxylic acid salts of this amine such as the acetates.

Evaluation of the Invention

Hexamethylene tetramine was injected into a 100 standard cubic feet per minute laboratory precipitator which was treating combustion flue gases. When injected in a temperature zone from 250° F.–400° F., a 0.34% approximate application rate (per wt. ash) reduced ash emissions 67%. When the substance was applied at the same rate, in a temperature range from 400° F.–710° F., it decreased ash emissions approximately 37%.

It is well known that hexamethylene diamine is ineffective in improving precipitator performance and under both field and laboratory conditions, worsens precipitator performance. This suggests a benefit that is specific to the tetramine moiety.

I claim:

1. A method of improving the conductivity of particles entrained in a stream of particle-laden gas formed by the burning of coal, which particles are collected by an electrostatic precipitator which comprises treating said gas containing particles prior to contact with the electrostatic precipitator at a temperature not greater than about 800° F. with a resistivity-decreasing amount of hexamethylene tetramine or its water-soluble salts and thereafter passing the gas to the electrostatic precipitator.

2. The method of claim 1 where the temperature is not greater than 500° F.

* * * * *